United States Patent [19]

Frauca

[11] Patent Number: 4,941,610

[45] Date of Patent: Jul. 17, 1990

[54] CONSTRUCTION PIECE FOR TOY VEHICLE TRACK

[75] Inventor: Vicente T. Frauca, Cosejo de Ciento, Spain

[73] Assignee: Irwin Toy Limited, Toronto, Canada

[21] Appl. No.: 304,621

[22] Filed: Feb. 1, 1989

[30] Foreign Application Priority Data

Jun. 24, 1988 [ES] Spain ..... 8802034
Nov. 24, 1988 [ES] Spain ..... 8803501

[51] Int. Cl.[5] ..... E01B 23/00

[52] U.S. Cl. ..... 238/10 A; 238/10 E; 238/10 F; 446/446; 446/94; 446/471

[58] Field of Search ..... 238/10 A, 10 R, 10 E, 238/10 F; 446/444, 446, 128, 93, 94, 95, 471, 447; 104/DIG. 1; 105/1.5

[56] References Cited

U.S. PATENT DOCUMENTS 4,241,875 12/1980 Vandenbrink ..... 238/10 R
4,372,489 2/1983 Lee ..... 238/10 E
4,540,119 9/1985 Neuhierl ..... 238/10 F

FOREIGN PATENT DOCUMENTS 0534783 2/1954 Belgium ..... 238/10 R
0728871 3/1966 Canada ..... 446/93
1478451 5/1969 Fed. Rep. of Germany ..... 446/128
295966 6/1987 Spain .
296287 12/1987 Spain .
8204195 12/1982 World Int. Prop. O. ..... 446/93

*Primary Examiner*—Andres Kashnikow
*Assistant Examiner*—Mark T. Le
*Attorney, Agent, or Firm*—Bereridge, DeGrandi & Weilacher

[57] ABSTRACT

A construction piece usable, in combination with other identical pieces, for forming a toy vehicle track, having interengaging slots and studs whereby a front side of one piece may be connected to the rear side of another, with slight inclination of the pieces being possible to allow for a curved track. On one face of the piece are segments of a road type tract suitable for a toy vehicle, and from the opposite face project rectangular segments which together provide rail tracks for a toy railway vehicle; this allows the track to be used with either of the two track types uppermost. The piece also has studs projecting from its ends which can engage in sockets in like pieces to form various structures. A construction set incorporating such track forming parts may also include toy vehicles having studs or sockets which can co-operate with corresponding track parts so that complex vehicles can be made.

5 Claims, 2 Drawing Sheets

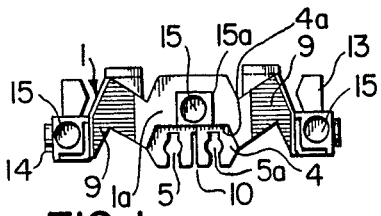
FIG. 1a
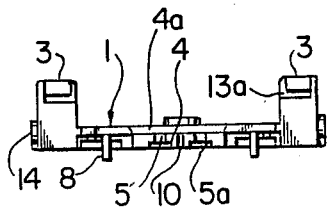
FIG. 1b
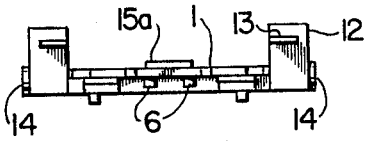
FIG. 1c
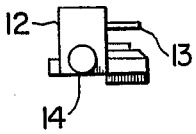
FIG. 1d
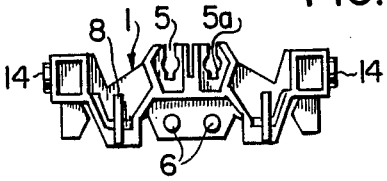
FIG. 1e
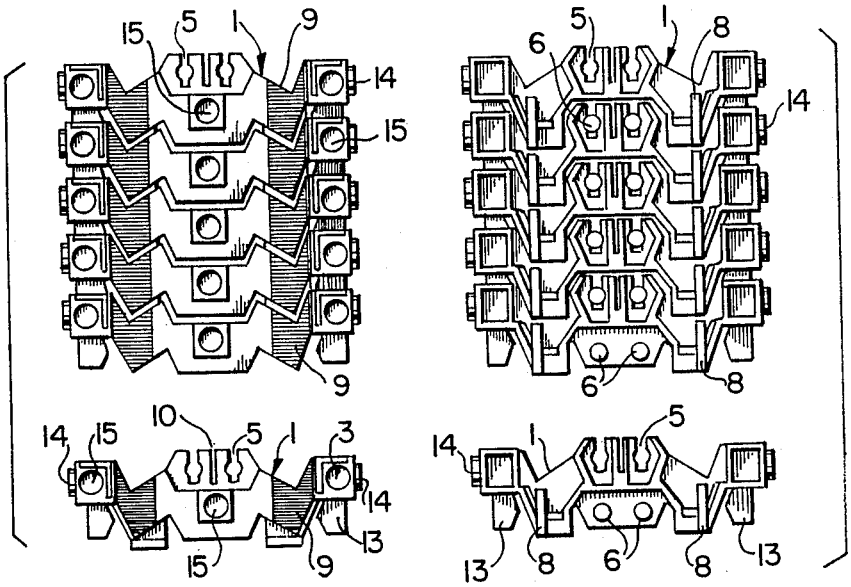
FIG. 2a
FIG. 2b

CONSTRUCTION PIECE FOR TOY VEHICLE TRACK

OBJECT OF THE INVENTION

The present invention provides a construction set piece which can be used for making toy vehicle tracks and and other structures.

PRIOR ART

There are currently on the market many toy construction sets which are intended for the construction of straight or curved runways or tracks, over which travels a toy self propelled vehicle. In one known type a series of pieces of a flexible runway or track for toy vehicles may be coupled to each other by means of plug and socket joints, each piece being angularly inclined with respect to the others. The tracks so provided may have a series of channels or grooves which guide the movement of the vehicle. At present, in order to construct a track which is elevated or descends, or else is equipped with tunnels or bridges, recourse must be made to elements which are extraneous to the track pieces, since those pieces may only be used for the construction of the track and cannot be used to make other structures.

It would be desirable to design construction kits in such a way that the parts of which they consist can be used not only for the construction of a track over which a vehicle travels, but at the same time might be used to build a series of structures based on a child's imagination, without the need to use elements extraneous to the track pieces.

DESCRIPTION OF THE INVENTION

The construction set embodying the invention provides an extremely simple and consequently low cost solution to this problem, which offers a multiplicity of applications, and which furthermore mays be easily handled.

The construction set of this invention is based on a single track piece, preferably molded of a plastic material, having a shape superficially similar to those already on the market, but which is provided with all the elements necessary for being coupled with like pieces in other than the usual track arrangements, by means of sockets or plugs. The track pieces are also equipped with a means permitting the angular inclination of one part with respect to another, in order to make a series of curves in the track. One piece of this construction set is connected with another, in the track-forming mode, by means of the engagement of two grooves in the one piece with two small studs located in the lower area of an adjacent piece, and this not only makes possible a firm connection between the two pieces, but at the same time allows a possible curvature.

These pieces are also equipped adjacent their ends with a series of projections in the form of cylindrical studs preferably projecting from opposite ends of each piece and having the same diameter as sockets located on the upper face of each piece, in order that a stud of each piece can be connected to a socket of another piece.

In the middle of these pieces is a further socket the purpose of which is to permit connection of the studs onto the central zone of another piece.

The reason for these special projections and sockets is to permit these pieces to be used to construct, not only tracks of varying curvature, but also tunnels, bridges, and other structures.

These pieces may also be used to build special toy vehicles equipped with studs or sockets which match those of the pieces.

Each piece has a first surface (hereinafter termed for convenience the "top" surface) providing segments of a road type track, and an opposite (or "bottom") surface having projecting rectangular rail track segments for a toy train; the track can be used with either side uppermost depending on the desired use.

Another feature of this invention is the provision of toy vehicles having means whereby the track pieces described can be connected on to the vehicles to make complex built-up vehicles. Such vehicles may have:

(1) Studs for receiving the sockets of the track piece;

(2) Sockets for receiving the studs of the track piece; and/or;

(3) Means such as small studs or grooves which cooperate with corresponding parts in the track piece, being those parts which allow the track pieces to be connected together in track-forming mode.

DESCRIPTION OF THE DRAWINGS

The present invention will now be described by way of example with reference to the accompanying drawings, in which:

FIG. Nos. 1*a*, 1*b*, 1*c*, 1*d*, and 1*e*, show the construction set piece respectively from the top, front, rear, side and bottom, FIG. Nos. 2*a* and 2*b* show an application of the construction piece from its upper and lower sides, respectively, FIG. No. 3 shows a view of the assembly possibilities of the piece with others which are exactly like it;

Figure 3:
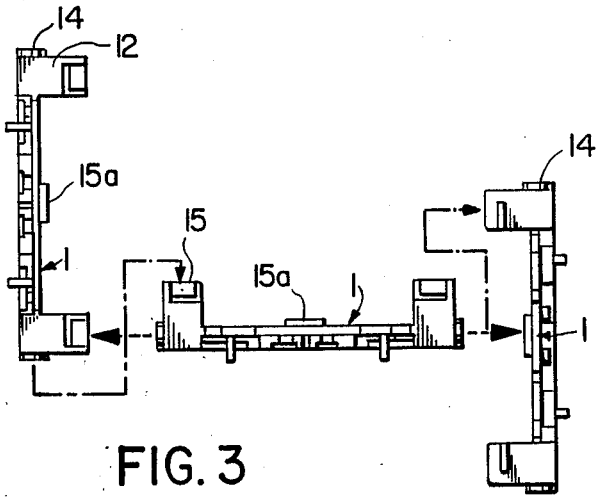

FIG. No. 4 shows how track pieces can be attached to a toy vehicle, and

FIG. Nos. 5 and 6 show further views of the vehicle.

DETAILED DESCRIPTION

Looking at the drawings, it can been seen how the construction set is made from a single piece 1 obtained by molding from a plastics material. A flat central area 1*a* of the piece is more or less hexagonal in shape, and has a front part 4, projecting below an abutment edge 4*a*, and having a long and narrow recess 10 coincident with the axis of symmetry of the piece itself. This recess 10 is flanked by horizontally elongated, open fronted recesses 5 of greater width and each with an intermediate circular widening, these recesses being flanged on the underside by undercut recesses 5*a* as shown in FIG. 1*e*. On the rear side, opposite these recesses and on the lower surface of part 1*a*, there are two downwardly projecting, small cylindrical studs 6 which are normally vertical and situated symmetrically of the axis and suitably spaced apart to fit within recesses 5 of an adjacent like piece by a horizontal sliding action, as shown FIGS. 2*a* and 2*b*. The nature of the recesses 5 allows for a slight inclination between the two adjacent pieces when it is desired to make a curved track, since the studs 6 can move slightly within the recesses 5.

On the top face the piece 1 is equipped with transversely scored track segments 9 extending across the piece on each lateral side of the central area 1*a*, these segments together forming a road track for a road wheel type toy vehicle, as shown in FIG. 2*a*, and providing suitable grip for the wheels. Guidance for the road vehicle is provided by pillars 12, one projecting upwardly from each end portion of the piece 1, these being in the nature of flange elements the inner surfaces of which form flanges enclosing the track sides. On the "bottom" surface of each piece is provided a pair of parallel rectangular ribs 8 which are aligned end to end when the pieces are connected, and which provide rails for a railway type vehicle when the track is inverted as shown in FIG. 2*b*. It will be seen that these ribs 8 are located inwardly of the end portions of the track piece which carry the pillars 12.

Pillars 12 are provided with rearwardly extending horizontal fins 13, which fit into front opening slots 13*a* in the pillars of the adjacent piece; these interfitting parts help to minimize twisting of the track formed from the pieces.

Projecting outwardly from each end of piece 1 is a circular stud 14, dimensioned to fit within any circular socket 15 provided firstly at the top of each pillar 12 and secondly within a central projection 15*a* in the top of central area 1*a*. These studs and sockets allow the parts to be fitted together in a variety of configurations, some of which are shown by way of example in FIG. 3. Also, the pieces 1 can be attached by means of these studs and sockets to special toy vehicles having similar studs and recesses, such as the vehicle illustrated in FIG. 4, to make a composite vehicle.

This single track piece thus forms, with successive connections at various parts of its surface, a component which can be used for tracks on which self-propelled vehicles may move or else railway tracks, and with imaginative connections, may form different types of bridges, tunnels, vehicles, superposed elevated highways, etc., and thus constitutes an element which stimulates the user's imagination, permitting thousands of combinations which contribute toward the child's education.

Figure 4:
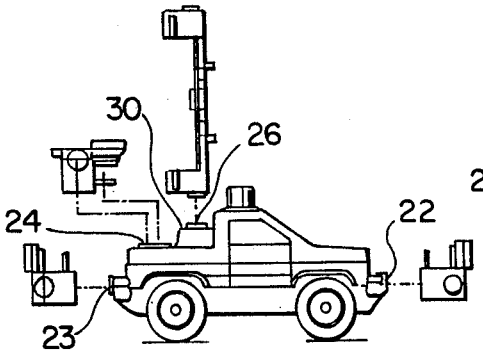
Figure 5:
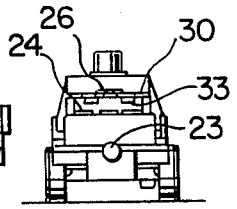
Figure 6:
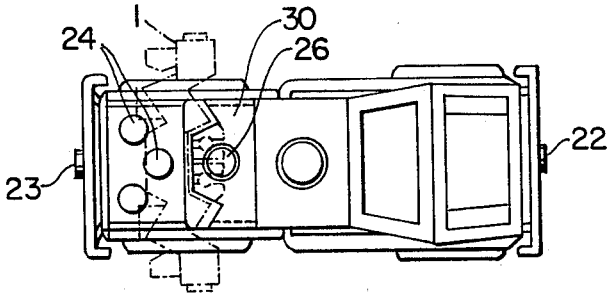

The vehicle 20 illustrated in FIGS. 4, 5 and 6 is an example of a toy road vehicle in the form of a truck. Many other road or rail type toy vehicles can be used with the roadway track or rail track formed by the pieces described above. Such vehicles are designed with various parts which are connectable to the track forming pieces described, notably:

(a) Cylindrical studs 22 and 23 projecting forwardly and rearwardly from the centres of the front and rear vehicle bumpers, and studs 24 projecting upwardly from the cargo-carrying areas of the truck, all these being connectable into sockets 15 of the track piece; and (b) Parts provided on a platform 30 raised above the cargo-carrying area. These include a hollow projection 26 similar to part 15*a* of the track piece, and small studs 33 projecting downwardly from the platform 30 and sized similarly to studs 6 of the track piece to receive grooves 5 of the track piece when the part thereof carrying these studs is inserted under the platform 30. As shown in FIG. 6, the rear of the platform 30 is notched to match with the front edge of the track piece and the rear edge engages abutment surface 4*a*.

Various ways in which the vehicle may be connected to the track part are shown in FIG. 4.

The materials, shape, size and placement of the elements may be varied, provided that they do not require a change in the basic concept of the invention, as defined by the following claims.

I claim:

1. A toy track piece capable of being joined with other identical pieces to form a toy vehicle track by having interengaging means for connecting a front side of one piece to the rear side of an identical piece, characterized by being laterally elongated and having on one face a segment of a generally flat road-type track for a toy road vehicle, said road-type track being defined at its sides by flange elements which project upwardly from each end portion of said track piece and which together with flange elements of said other identical pieces form flanges enclosing the track sides, and by having on the opposite face a pair of projecting rectangular segments which together provide rail tracks for a toy railway vehicle, said rectangular segments being located inwardly of said end portions of the track piece which carry the flange elements.

2. A piece according to claim 1, further characterized by the fact that the piece is provided with projections at its ends and with sockets dimensioned to snugly receive the projections of identical pieces, said socket being on said one face thereof and being located on said projecting flange elements to lie at the sides of said road-type track.

3. A piece according to claim 2, further characterized by the fact that in the centre of said one face of the piece there is a second projection within which there is one of said sockets.

4. A track piece according to claim 1, wherein each said segment of road-type track is transversely scored.

5. The combination of a toy vehicle with a track piece usable, in combination with other identical pieces, for forming a track for said vehicle, said piece having interengaging means whereby a front side of one piece may be connected to the rear side of an identical piece, said interengaging means comprising a pair of centrally located studs, which studs are located on a rear side of the piece and project vertically when the piece is in normal orientation for forming a horizontal track, and further comprise a complementary pair of horizontally elongated open fronted recesses on the front side of said piece which are arranged to receive said vertically projecting studs of said identical piece by horizontal sliding when the pieces are in front-to-rear track forming relationship; and wherein said vehicle includes a platform having depending studs sized and located to engage in said pair of recesses of the track piece.

* * * * *